US005428551A

United States Patent [19]

Trainor et al.

[11] Patent Number: 5,428,551

[45] Date of Patent: Jun. 27, 1995

[54] TAP CHANGER MONITOR APPARATUS AND METHOD

[75] Inventors: John J. Trainor, Wake Forest; Carl J. Laplace, Raleigh, both of N.C.; Michael A. Bellin, Brandon, Miss.; James H. Harlow, Largo, Fla.

[73] Assignee: Siemens Energy & Automation, Inc., Alpharetta, Ga.

[21] Appl. No.: 952,459

[22] Filed: Sep. 23, 1992

[51] Int. Cl.[6] ..... G05F 1/14

[52] U.S. Cl. ..... 364/483; 323/255; 323/256

[58] Field of Search ..... 364/483; 323/255, 256, 323/257

[56] References Cited

U.S. PATENT DOCUMENTS

| | | | |
|---|---|---|---|
| 3,721,894 | 3/1973 | Beckwith | 323/20 |
| 4,361,730 | 11/1982 | Barber et al. | 179/5 R |
| 4,419,619 | 12/1983 | Jindrick et al. | 364/483 |
| 4,433,387 | 2/1984 | Dyer et al. | 364/900 |
| 4,484,307 | 11/1984 | Quatse et al. | 364/900 |
| 4,503,291 | 3/1985 | von Holten et al. | 179/90 AN |
| 4,612,617 | 9/1986 | Laplace et al. | 364/483 |
| 4,628,158 | 12/1986 | Rubin | 379/10 |
| 4,630,220 | 12/1986 | Peckinpaugh | 364/483 |
| 4,645,874 | 2/1987 | Fildes | 379/93 |
| 4,686,630 | 8/1987 | Marsland et al. | 364/483 |
| 4,996,646 | 2/1991 | Farrington | 364/483 |
| 5,049,804 | 9/1991 | Hutchings | 320/20 |
| 5,065,321 | 11/1991 | Bezos et al. | 364/424.04 |
| 5,077,582 | 12/1991 | Kravette et al. | 355/206 |
| 5,105,370 | 4/1992 | Shaw et al. | 364/550 |
| 5,105,371 | 4/1992 | Shaw et al. | 364/550 |
| 5,107,446 | 4/1992 | Shaw et al. | 364/550 |
| 5,117,175 | 5/1992 | Pettigrew et al. | 323/256 |
| 5,119,012 | 6/1992 | Okamura | 323/258 |
| 5,138,562 | 8/1992 | Shaw et al. | 364/550 |

*Primary Examiner*—Kevin J. Teska
*Assistant Examiner*—Tyrone Walker

[57] ABSTRACT

A monitor is provided for use with an AC voltage regulator having a number of taps including a neutral tap and a tap changer capable of activating any of the taps. The voltage regulator receives an input voltage and produces an output voltage and is constructed so that the output voltage bears a relationship to the input voltage that depends on the activated tap. The tap changer is constructed to activate different taps as necessary to maintain the output voltage close to a target level despite fluctuations of the input voltage or load. The monitor apparatus includes a switch responsive to activation of the neutral tap for providing initial activated-tap information and a dead-reckoning computation device responsive to changes of the activated tap for updating the activated-tap information in accordance with changes of the activated tap made after the activation of the reference tap.

16 Claims, 3 Drawing Sheets

VOLTAGE REGULATOR 12

TAP CHANGER MONITOR APPARATUS AND METHOD

BACKGROUND OF THE INVENTION

1. Field of the Invention

This invention relates to a monitor apparatus and method adapted for use with industrial-type voltage regulators and more particularly to a novel and highly effective monitor apparatus and method for efficiently keeping track of the tap position of an AC voltage regulator as it changes and maintaining a record of the tap position extremes between resets, thereby elevating standards of economy, maintenance, safety, and system performance analysis.

2. Description of the Prior Art

In service, a voltage regulator is supplied with an input voltage and in response thereto produces an output voltage. The purpose of a voltage regulator is to produce an output voltage that is well regulated: i.e., substantially constant at some predetermined target level, despite fluctuations in the input voltage and load from their normal values. An AC voltage regulator for industrial use typically comprises an autotransformer having a number of spaced-apart output terminals and performs its regulatory function by adjusting the tap position (in other words, tapping the output terminals at a selected position) so that, for a given input voltage, the output is taken from whichever tap yields an output voltage closest to the target level.

The number of taps provided depends on the environment in which the voltage regulator is designed to operate and the fineness or resolution with which it is necessary to control the output voltage. One type of voltage regulator in common use has the equivalent of 33 taps. These taps can be thought of as consisting of a centrally positioned neutral tap, 16 taps on one side of the neutral tap respectively corresponding to excursions of the input voltage of increasing magnitude in one direction from normal, and 16 taps on the opposite side of neutral respectively corresponding to excursions of the input voltage of increasing magnitude in the opposite direction from normal. In practice, such a voltage regulator has a neutral tap plus first through eighth additional taps and a reversing switch. The tap changer can be placed on the neutral tap to yield an output voltage equal to the input voltage. With the reversing switch in the "raise" position, the tap changer can be placed on the neutral and first taps for a one-raise, entirely on the first tap for a two-raise, on the first and second taps for a three-raise, entirely on the second tap for a four-raise, and so on until the tap changer is entirely on the eighth tap for a sixteen-raise. With the reversing switch in the "lower" position to reverse the current through the coil, the tap changer can be moved in the same way over the same taps to obtain any lower position ranging from a one-lower to a sixteen-lower.

The dynamic range at the input side is typically the normal input voltage plus or minus 10%. When the input voltage is at its normal value, the voltage regulator tap position is normally in neutral and the output voltage of the voltage regulator is equal to the input voltage.

Operators of large industrial electrical installations employing voltage regulators with tap changers need information about voltage regulator tap position because of its bearing on economy of operation, maintenance, safety, and system performance analysis.

Consider the matter of economy of operation. Sometimes, because of poor performance of a voltage regulator, power is supplied at a voltage which, although not so high as to damage the electrical components that receive power from the voltage regulator, is higher than the voltage required. In such a case, more power is delivered than is necessary, and the excess power is wasted. In a large industrial application, the waste can be quite substantial.

From the standpoint of maintenance and safety, in certain circumstances it is necessary to move the voltage regulator quickly and reliably to its neutral position. It is essential that the voltage regulator tap position be in neutral whenever the voltage regulator is placed in or removed from service. Information about current tap position is necessary to accomplish this.

From the standpoint of system performance analysis, a record of the successive active tap positions of a voltage regulator is a useful measure of the range and frequency of input voltage excursions and load changes, which are related respectively to the performance of the power supply to the voltage regulator and the performance of the system to which the voltage regulator supplies power.

Various kinds of apparatus have been developed in the past for determining the tap position of a voltage regulator. These prior developments have culminated in the standard electromechanical tap position indicator, which is physically attached to the tap changer mechanism, a mechanical device that changes the tap position by physically moving from tap to tap. The attached electromechanical tap position indicator moves with the tap changer mechanism and displays the tap position on a dial or in some other conventional manner.

The standard, conventional electromechanical meter has a number of drawbacks. For one, it has costly moving parts that wear out and is inherently less reliable and more expensive than one would wish. Moreover, it produces only a local meter indication, which can be read by an operator only by going to the site of the meter. While of course any meter reading can be converted into a signal that can be transmitted to a remote location for reading or to a centrally located computer for processing, such conversion requires an "add-on" device that increases the cost of the basic electromechanical meter.

Other prior art relating to the monitoring or determination of the tap position of a tap changer is found in U.S. Pat. Nos. 4,419,619, 4,612,617 and 5,119,012. The devices shown in these patents all have various drawbacks, including relative complexity and a failure to provide certain information or a failure to provide information in a form desired by operators of large industrial installations incorporating voltage regulators.

OBJECTS AND SUMMARY OF THE INVENTION

An object of the invention is to provide a remedy for the problems of the prior art outlined above. In particular, an object of the invention is to provide improved monitor apparatus for use with a voltage regulator that reliably and inexpensively keeps track of the tap position as it changes.

Another object of the invention is provide monitor apparatus for maintaining a record of the tap position extremes between resets.

Other objects of the invention are to provide monitor apparatus that provides information on tap position in a form that is convenient and easily accessible at a remote location and to elevate standards of economy, maintenance, safety, and system performance analysis.

These and other objects are attained in a first independent aspect of the invention by the provision of monitor apparatus for use with a voltage regulator having a plurality of taps including a reference tap and a tap changer capable of activating any of said taps, the voltage regulator being adapted to receive an input voltage and to produce an output voltage and being constructed so that the output voltage bears a relationship to the input voltage that depends on the activated tap and the tap changer being constructed to activate different taps as necessary to maintain the output voltage close to a target level despite fluctuations of the input voltage or load; the monitor apparatus comprising means which responds to activation of the reference tap for providing initial activated-tap information and dead-reckoning means which responds to changes of the activated tap for updating the activated-tap information in accordance with changes of the activated tap made after the activation of the reference tap.

From an independent standpoint, the objects of the invention are attained in a method of monitoring a voltage regulator having a plurality of taps including a reference tap and a tap changer capable of activating any of the taps, the voltage regulator being adapted to receive an input voltage and to produce an output voltage and being constructed so that the output voltage bears a relationship to the input voltage that depends on the activated tap and the tap changer being constructed to activate different taps as necessary to maintain the output voltage close to a target level despite fluctuations of the input voltage or load; the method comprising the steps of: detecting activation of the reference tap; providing initial activated-tap information in response to said detection; and updating the activated-tap information in accordance with changes of the activated tap made after the activation of the reference tap.

Preferably, the reference tap referred to above is the neutral tap, although another tap can in principle be designated the reference tap.

In accordance with another independent aspect of the invention, counter means for counting tap position changes is provided, together with resettable means for updating the counter means in response to tap changes executed in accordance with tap change requests and for recording maximum and minimum tap positions between resets of the counter means.

In accordance with the invention, all of the features of the invention summarized above are preferably practiced in combination.

BRIEF DESCRIPTION OF THE DRAWINGS

A better understanding of the objects, features and advantages of the invention can be gained from a consideration of the following detailed description of the preferred embodiment of the invention, in conjunction with the appended figures of the drawing, wherein a given reference character always designates the same element or part, and wherein.

DESCRIPTION OF THE PREFERRED EMBODIMENT

Overview

Figure 1:
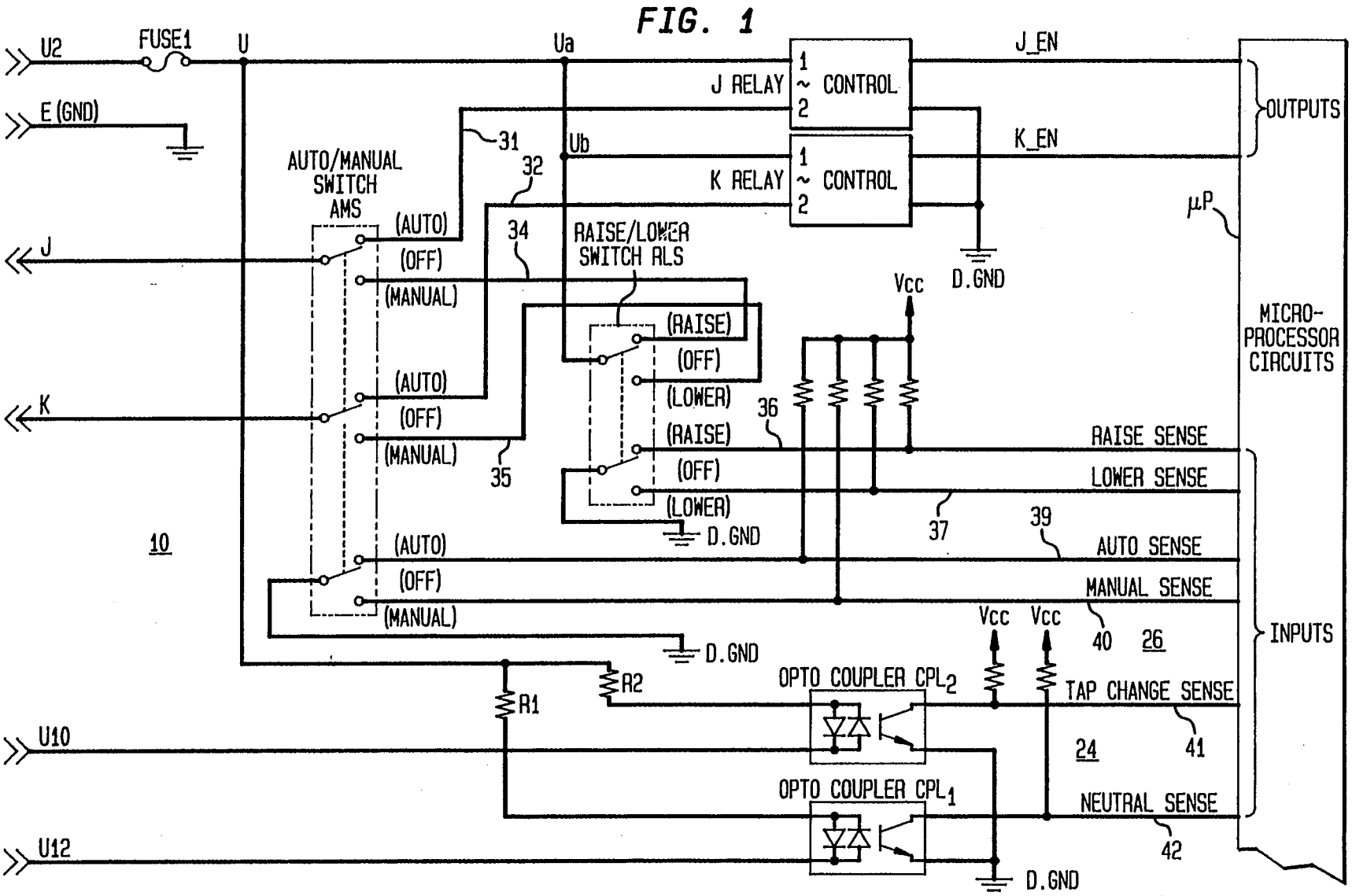
FIG. 1 is a schematic diagram of a preferred embodiment of apparatus constructed in accordance with the invention, showing terminals by which it is electrically connected to a conventional voltage regulator.

FIG. 1 discloses monitor apparatus 10 for use with a voltage regulator 12 (FIG. 2) having a plurality of taps including a neutral tap 0 and taps 1, 2, . . . N−1, N for raising (boosting) or lowering (bucking) the input voltage S. The voltage regulator 12 can be, for example, a Siemens JFR series. The voltage regulator 12 also includes a tap changer 18 capable of activating any of the taps 0, 1, 2, . . . N−1, N. If the tap changer 18 is entirely on the neutral tap 0, the output voltage L is equal to the input voltage S. If the tap changer is on the 0 and 1 taps, it produces a one-raise or a one-lower output, depending on whether the reversing switch RS is on terminal A or on terminal B. If the reversing switch RS is on terminal A, it results in a raise; if it is on terminal B, it results in a lower (unless, of course, the tap changer 18 is on the neutral tap 0). The tap changer 18 can thus move from the neutral position 0 through a one-raise to a sixteen-raise (with the reversing switch RS on terminal A) or from a one-lower to a sixteen-lower (with the reversing switch on terminal B). If the dynamic range D is plus or minus 10% with respect to the normal input voltage, each step of the tap changer amounts to an adjustment of the output voltage equal to $\frac{5}{8}$% (10÷16)% of D/2. A finer adjustment can be obtained by, for example, providing more taps.

The voltage regulator 12 is thus adapted to receive an input voltage S on a line 20 and to produce an output voltage L on a line 22 and is constructed so that the output voltage on the line 22 bears a relationship to the input voltage on the line 20 that depends on the activated tap 0, 1, 2, . . . N−1, N. The tap changer 18 is constructed to activate different ones of the taps as necessary to maintain the output voltage close to a target level despite fluctuations of the input voltage or load.

The monitor apparatus 10 comprises means 24 responsive to activation of the reference tap 0 for providing initial activated-tap information and dead-reckoning means 26 responsive to changes of the activated tap for updating the activated-tap information in accordance with changes of the activated tap made after the activation of the reference tap 0.

In brief, apparatus constructed in accordance with the invention monitors a neutral indicator signal U12, a tap position change indication signal U10, the position of an automatic/manual (mode) switch AMS, and the position of a tap raise/lower switch RLS. The apparatus also keeps track of internal control signals J_EN and K_EN which are generated by a microcomputer μP and enable J and K relays, respectively, in the automatic mode. The microcomputer μP can be, for example, a Motorola MC68HC16Z1. The J relay controls tap raise operations, while the K relay controls tap lower operations.

Figure 2:
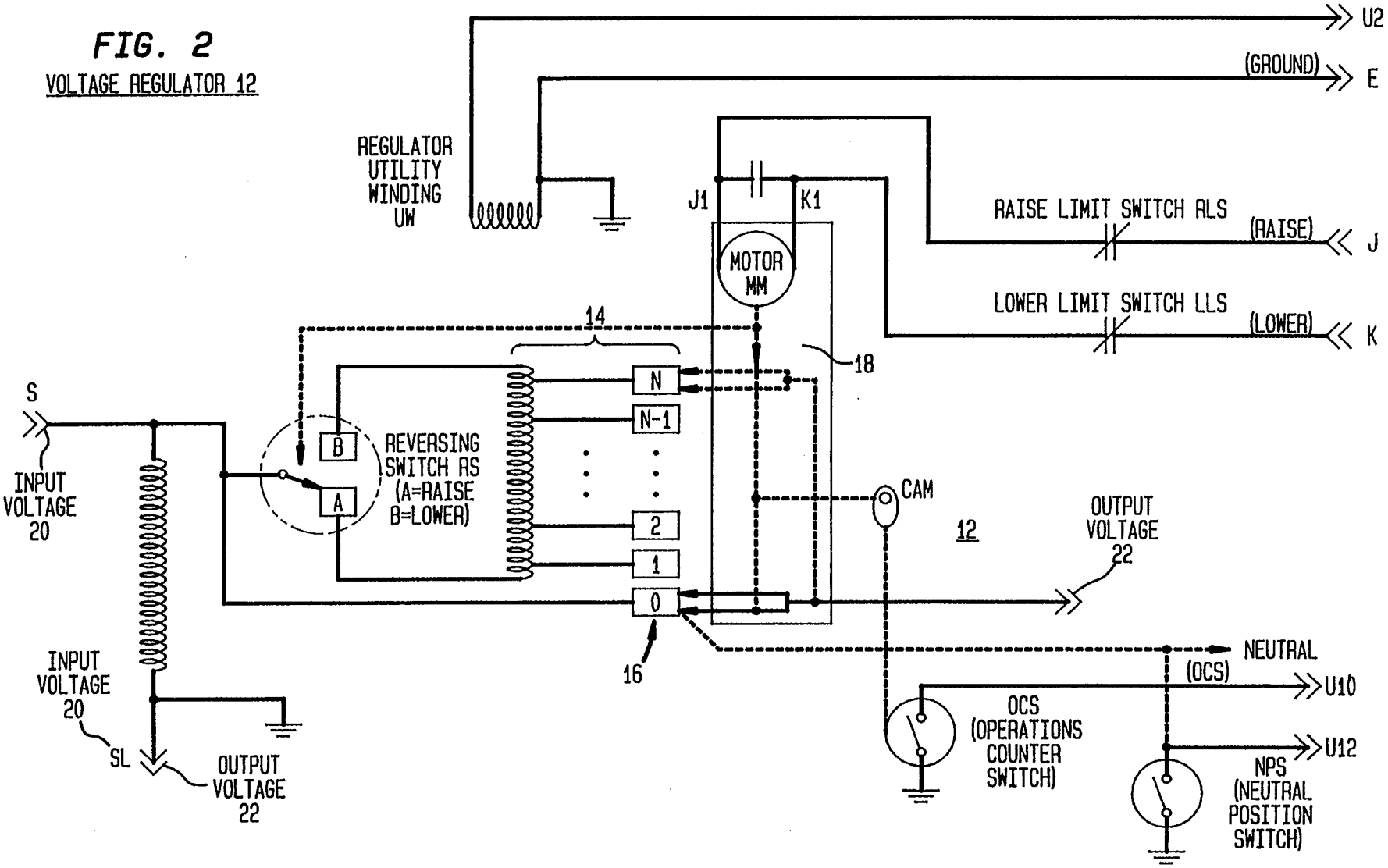
FIG. 2 is a schematic diagram that should be placed on the left of FIG. 1, showing the same terminals plus details of the voltage regulator.

Until the neutral signal U12 goes active, the tap position is unknown. Once the neutral signal U12 goes active (i.e., the neutral-position switch NPS shown in FIG. 2 is closed), the microcomputer μP sets its internal tap position value to neutral. After this occurs, the microcomputer μP tracks the tap position on the basis of the inputs described above.

The microcomputer μP maintains an internal command history for tap raise and lower requests, for both manual and automatic tap-change requests. The microcomputer μP in effect time-stamps each tap-change request and each tap-change request cancellation. (Occasionally, the microcomputer μP will cancel a tap-change request if conditions have changed in such a way that no tap change is warranted.) When a tap change is sensed (i.e., the signal U10 changes state), the microcomputer μP uses the internal command history to determine whether the tap change was a raise or a lower, and updates its internally stored tap position accordingly.

The tap control algorithm running on the microcomputer μP monitors several signals to determine when tap change commands are issued or cancelled. If the automatic/manual switch AMS is in the manual position and the tap raise/lower switch RLS is in the raise position, the algorithm records a manual tap-raise command. Similarly, if the automatic/manual switch AMS is in the manual position and the tap raise/lower switch RLS is in the lower position, the algorithm records a manual tap-lower command. When the switch positions are changed, the algorithm updates its command history to reflect the new switch state.

When the automatic/manual switch AMS is in the automatic position, the tap control algorithm monitors the state of the computer-controlled signals, J_EN and K_EN, to determine when automatic tap-change requests are asserted or cancelled. The signals J_EN and K_EN are controlled by an independent algorithm that monitors the regulator voltages, current, power flow status, voltage settings, bandwidth settings, and other criteria to determine if an automatic tap raise or tap lower request should be made. The tap control algorithm updates its internal command history when it detects automatic tap-change requests and request cancellations.

The apparatus also checks for the reasonableness of the tap-change requests. Since tap changes take approximately five seconds to implement after a tap-change request is made, the switches and/or internal control signals need to remain in the same state for this period of time. The algorithm allows for some deviations in the tap changer timing, but if it finds that the conditions are out of bounds for an accurate tap position indication, it will activate an error condition. This will alert the operator that the displayed tap position may be inaccurate. The algorithm also checks its accuracy (and corrects itself if necessary) each time the tap position reaches neutral (identified by closing of the neutral-position switch NPS).

Schematic Detailed Description

The voltage regulator 12 (FIG. 2) supplies power for the regulator monitor 10 via its utility winding UW through a terminal U2. The terminal U2 is nominally at 120 VAC, with sufficient current capability to supply the monitor 10 as well as the tap changer motor MM.

When the auto/manual switch AMS is in the auto position, the microcomputer μP controls the J1 and K1 voltages to the tap changer motor MM via control signals J_EN and K_EN, which control respective relays J and K. When the relay J is enabled, 120 VAC is provided from the utility winding UW through terminal U2, junction U, the J relay, a line 31, the switch AMS, terminal J, and raise limit switch RLS to the J1 terminal of the motor MM. This activates the winding of the motor MM for raising the tap position. When the relay K is enabled, 120 VAC is provided from the utility winding UW through terminal U2, junctions U, Ua and Ub, the K relay, a line 32, the switch AMS, terminal K, and lower limit switch LLS to the K1 side of the motor MM. This activates the winding of the motor MM for lowering the tap position.

When the auto/manual switch AMS is in the manual position, the tap raise/lower switch RLS controls supply of the J1 and K1 voltages. In that case, when the raise/lower switch RLS is in the raise position, 120 VAC is applied at J1 via a line 33, 34, the switch AMS, the terminal J, and the switch RLS, activating the motor winding for raising the tap position. On the other hand, when the raise/lower switch RLS is in the lower position, 120 VAC is applied at K1 via the line 33 and a line 35, the switch AMS, etc., activating the winding of the motor MM for lowering the tap position. When the tap raise/lower switch RLS is in the raise position, a line 36 is grounded, and the raise sense signal on the line 36 goes active, indicating to the microcomputer μP that the raise/lower switch RLS is in the raise position. When the tap raise/lower switch RLS is in the lower position, a line 37 is grounded, and the lower sense signal goes active on the line 37, indicating to the microcomputer μP that the raise/lower switch RLS is in the lower position.

The auto/manual switch AMS controls an auto sense signal and a manual sense signal on respective lines 39, 40. When the switch AMS is in the auto position, the line 39 is grounded, and the auto sense signal goes active on the line 39, indicating to the microcomputer μP that the switch AMS is in the auto position. When the switch AMS is in the manual position, the line 40 is grounded, and the manual sense signal goes active on the line 40, indicating to the microcomputer μP that the switch AMS is in the manual position.

The regulator 12 has a neutral position switch NPS that provides the sense signal U12. The microcomputer μP senses whether this switch NPS is open or closed via a resistor R1 connected on one side to 120 VAC and on the other side to a first optocoupler $CPL_1$. When the switch NPS is open, the transistor of the first optocoupler $CPL_1$ is off because no current flows through resistor R1. The neutral sense input to the microcomputer μP is therefore high on a line 42, which is biased by a resistor to VCC. The first optocoupler $CPL_1$ comprises a pair of light-emitting diodes mounted in parallel but oriented in opposite directions so as to conduct during both half-cycles of the VAC and a photosensitive transistor. When the neutral-position switch NPS is closed, the photodiodes of the first optocoupler $CPL_1$ are in a completed circuit and begin to conduct (except when the AC signal magnitude drops below $\approx 1.4$ volts). The neutral sense signal goes low on line 42 because of its connection to ground, with periodic high pulses. The microcomputer μP filters out the high pulses to sense that the neutral position switch NPS is closed.

The regulator 12 also provides the sense signal U10, which is generated on a line connected to an operations counter switch OCS. The microcomputer μP senses whether this switch OCS is open or closed via a resistor R2 connected to the utility winding UW and a second optocoupler $CPL_2$. The second optocoupler $CPL_2$ comprises a pair of light-emitting diodes mounted in parallel but oriented in opposite directions so as to conduct during both half-cycles of the VAC and a photosensitive transistor. When the operations counter switch OCS is open, no current flows through the resistor R2 so that the transistor of the second optocoupler $CPL_2$ is off and the tap change sense input to the microcomputer $\mu P$ is high on line 41 because it is biased by a resistor to VCC. When the operations counter switch OCS is closed, the photodiodes of the second optocoupler $CPL_2$ conduct (except when the AC signal magnitude drops below $\approx 1.4$ Volts) and the transistor of the second optocoupler $CPL_2$ turns on. The tap change sense signal on the line 41 goes low because of the connection of the line 41 to ground through the transistor of the second optocoupler $CPL_2$. The microcomputer $\mu P$ filters out the periodic high pulses that result when the AC signal magnitude drops below $\approx 1.4$ volts and thereby senses that the switch OCS is closed.

The regulator 10 causes the state of the switch OCS to change when a tap position change occurs (i.e, whenever the OCS changes from closed to open or from open to closed, a tap position change has occurred).

The switch OCS is controlled by an eccentric cam which rotates through 180 degrees every time it is actuated. When the high side of the cam engages the switch OCS, the switch is closed; when the low side of the cam engages the switch OCS, the switch is open (this arrangement can of course be reversed). The cam turns through 180 degrees with every change of tap position. The switch NPS is controlled by a cam associated with the neutral position so that the switch NPS closes only when the tap changer is at the neutral position; otherwise, the switch NPS is open.

Minimum and Maximum Tap Position

The monitor 10 also monitors the extremes of the tap position. The maximum or minimum tap position reached can be displayed and/or cleared. When cleared, the maximum and minimum tap position parameters are set equal to the present tap position value. The microcomputer $\mu P$ stores the time and date that the tap position minimum and maximum values are cleared. This time and date can be viewed from the voltage regulator monitor display.

The monitor 10 also comprises a tap position counter and resettable means as explained below for updating the counter in response to tap changes executed in accordance with tap change requests and for recording maximum and minimum counts between resets.

Flowchart

Figure 3:
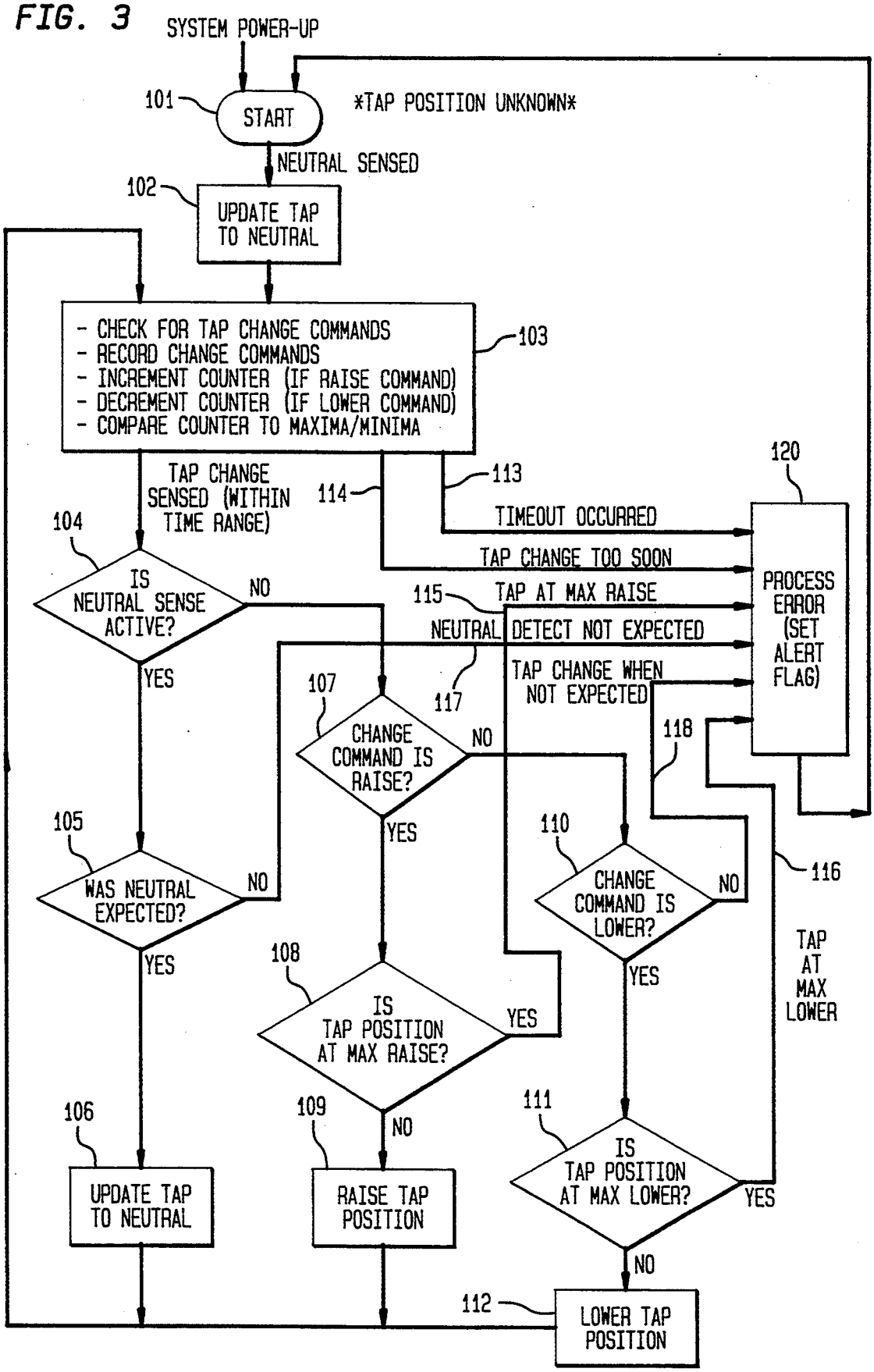
FIG. 3 is a flowchart helpful in understanding the operation of the apparatus of FIG. 1.

FIG. 3 is a flowchart helpful in understanding the operation of the apparatus of FIG. 1. After starting at step 101 and sensing neutral, the tap is updated to neutral at step 102. Then, at step 103, the program checks for tap change commands, records tap change commands, performs a timing function to ensure that the tap change is implemented within a predetermined time window (for example five seconds plus or minus one second), and compares the current tap position to previously stored maximum and minimum values. When a tap change is sensed within an allowed time period, a determination is made at step 104 whether the neutral sense signal on the line 42 (FIG. 1) is active. If the neutral sense signal is active, then at step 105 a determination is made whether neutral was expected. If so, the tap is updated to neutral at step 106, and the program recycles to step 103.

If at step 104 the neutral sense signal is found to be not active, then a determination is made at step 107 whether the tap change sensed prior to step 104 is a raise command. If so, then a determination is made at step 108 whether the tap position is at the maximum permissible raised position. If not, then at step 109 the tap position is raised, and the program recycles to step 103.

If at step 107 the tap change command is not found to be a raise command, then at step 110 a determination is made whether the tap change command is a lower command. If so, then at step 111 a determination is made whether the tap position is already at the maximum lower position permissible. If not, then at step 112 the tap position is lowered, and the program recycles to step 103.

Error Detection

In accordance with the invention, provision is made to detect error conditions.

If the tap change is not sensed within the time permitted, then a timeout occurs as indicated on line 113. On the other hand, if the tap change is too soon, an indication to that effect is forwarded on a line 114.

If at step 108 a determination is made that the tap position is already at the maximum raise, a raise command having been detected in step 107, then an error signal indicating that the tap is commanded to be impermissibly raised is forwarded on a line 115. (Moreover, a raise beyond the set limit is prevented by the opening of the raise limit switch RLS when the tap changer 18 moves to the raise limit.)

By the same token, if at step 111 a determination is made that the tap position is already at the maximum lower position, a change command to lower the tap having been detected at step 110, then an error signal indicating an impermissible change command is forwarded on a line 116; and a lower beyond the set limit is in any case prevented by the opening of the lower limit switch LLS when the tap changer 18 moves to the lower limit.

If at step 105 it is determined that neutral was not expected, the neutral sense signal on line 42 having been detected at step 104, then an error signal is forwarded on a line 117.

Finally, if a tap change has been sensed within the permissible time limit, the neutral sense signal is not active on line 42, and the command change investigated at steps 107 and 110 is neither raise nor lower, as indicated by a succession of negative answers at steps 104, 107, 110, then an error signal indicating a tap change when a tap change is not expected is forwarded on a line 118.

The signals on the line 113,114, 115, 116, 117, and 118 all indicate error conditions. These signals are all forwarded for processing of the error signals as indicated at step 120, which sets an alert flag and recycles the program back to the start 101.

Thus there is provided in accordance with the invention a novel and highly effective monitor apparatus for use with a voltage regulator having a plurality of taps including a reference tap and a tap changer capable of activating any of the taps. The invention provides for efficiently keeping track of the tap position of a voltage regulator as it changes and maintaining a record of the tap position extremes between resets, thereby elevating standards of economy, maintenance, safety, and system performance analysis and accomplishing the objects of the invention as set out above.

Many modifications of the preferred embodiment of the invention disclosed herein will readily occur to those skilled in the art. For example, the number of taps provided, the dynamic range of the input voltage and the type of microcomputer employed all can be varied, as those skilled in the art will readily understand. Moreover, the microcomputer can respond to either high or low signals to indicate a raise sense, lower sense, auto sense, manual sense, tap change sense, and neutral sense. It can also employ either high or low signals as J_EN and K_EN, appropriate adjustments being made with respect to the J relay and K relay. Similarly, switching devices other than optocouplers can be employed, and devices other than cams can be used to generate the signals U10 and U12. Many other modifications of the preferred embodiment of the invention disclosed above will readily occur to those skilled in the art. Accordingly, the invention is to be constructed as including all subject matter that falls within the scope of the appended claims.

We claim:

1. Monitor apparatus for use with a voltage regulator having a plurality of taps including a reference tap and a tap changer capable of activating any of said taps, the voltage regulator being adapted to receive an input voltage and to produce an output voltage and being constructed so that the output voltage bears a relationship to the input voltage that depends on the activated tap and the tap changer being constructed to activate different taps in response to tap raise and lower requests to maintain the output voltage close to a target level despite fluctuations of the input voltage or load;

said monitor apparatus comprising:

means responsive to activation of said reference tap for providing initial activated-tap information and dead-reckoning means activated by the initial activated tap information for storing a history of tap raise and lower requests after the activation of said reference tap and for employing the history to calculate the current tap position.

2. A monitor apparatus according to claim 1 wherein the reference tap is a neutral tap and the output voltage equals the input voltage when the neutral tap is activated.

3. A monitor apparatus according to claim 1 wherein the means responsive to the activation of the reference tap comprises first switch means having an open state and a closed state and changing from one of said states to the other in response to activation of said reference tap.

4. A monitor apparatus according to claim 3 further comprising a computer, wherein said first switch means comprises a first optocoupler connected to the computer and a first pair of make-break contacts, one of said first pair of contacts being permanently connected to the first optocoupler and, upon closing with the other of said first pair of contacts, activating the optocoupler to transmit a neutral-sense signal to the computer.

5. A monitor apparatus according to claim 1 wherein the dead-reckoning means comprises second switch means having an open state and a closed state and changing from one of said states to the other in association with each change in the activated tap.

6. A monitor apparatus according to claim 5 further comprising a computer, wherein said second switch means comprises a second optocoupler connected to the computer and a second pair of make-break contacts, one of said second pair of contacts being permanently connected to the second optocoupler and, upon closing with the other of said second pair of contacts, activating the second optocoupler to send a tap-change-sense signal to the computer.

7. A monitor apparatus according to claim 1 further comprising an auto/manual switch and a computer, said auto/manual switch having an auto position and said computer generating enable signals, further comprising relay means responsive to said enable signals, said relay means in response to said enable signals connecting power through said auto/manual switch when said switch is in said auto position to control changes of the activated tap.

8. A monitor apparatus according to claim 7 further comprising means for transmitting an auto sense signal and a manual sense signal to said computer in accordance with the state of said auto/manual switch.

9. A monitor apparatus according to claim 7 wherein said auto/manual switch has a manual position, further comprising a raise/lower switch for connecting power through said auto/manual switch when said auto/-manual switch is in said manual position to control changes of the activated tap.

10. Monitor apparatus for use with a voltage regulator having a plurality of taps including a reference tap and a tap changer capable of activating any of said taps, the voltage regulator being adapted to receive an input voltage and to produce an output voltage and being constructed so that the output voltage bears a relationship to the input voltage that depends on the activated tap and the tap changer being constructed to activate different taps as necessary to maintain the output voltage close to a target level despite fluctuations of the input voltage or load;

said monitor apparatus comprising:

counter means for counting tap position; and resettable means for updating said counter means in response to tap changes executed in accordance with tap change requests and for recording maximum and minimum tap positions between resets of the counter means.

11. A monitor apparatus for use with a voltage regulator having a plurality of taps including a reference tap and a tap changer capable of activating any of said taps, the voltage regulator being adapted to receive an input voltage and to produce an output voltage and being constructed so that the output voltage bears a relationship to the input voltage that depends on the activated tap and the tap changer being constructed to activate different taps in response to tap raise and lower requests to maintain the output voltage close to a target level despite fluctuations of the input voltage or load;

said monitor apparatus comprising:

means responsive to activation of said reference tap for providing initial activated-tap information and electronic circuitry for storing a history of tap raise and lower requests after the activation of said reference tap and for employing the history for tracking the tap position, prediction of tap change direction, and tracking and storing of tap position minimum and maximum positions; and computer means responsive thereto.

12. Monitor apparatus for use with a voltage regulator having a plurality of taps including a neutral tap and a tap changer capable of activating any of said taps;

the voltage regulator being adapted to receive an input voltage and to produce an output voltage and being constructed so that the output voltage bears a relationship to the input voltage that depends on the activated tap and the tap changer being constructed to activate different taps as necessary to maintain the output voltage close to a target level despite fluctuations of the input voltage or load;

said monitor apparatus comprising:

a computer;

a first switching circuit responsive to activation of said neutral tap for providing initial activated-tap information;

a dead-reckoning circuit including a second switching circuit responsive to changes of the activated tap for updating the activated-tap information in accordance with changes of the activated tap made after the activation of the neutral tap;

wherein the output voltage equals the input voltage when the neutral tap is activated;

wherein said first switching circuit comprises a first optocoupler connected to the computer and a first pair of make-break contacts, one of said first pair of contact being permanently connected to the first optocoupler and, upon closing with the other of said first pair of contacts, activating the optocoupler to transmit a neutral-sense signal to the computer;

wherein said second switching circuit comprises a second optocoupler connected to the computer and a second pair of make-break contacts, one of said second pair of contacts being permanently connected to the second optocoupler and, upon closing with the other of said second pair of contacts, activating the second optocoupler to send a tap-change-sense signal to the computer;

further comprising an auto/manual switch, said auto/manual switch having an auto position and a manual position and said computer generating enable signals;

further comprising a relay circuit responsive to said enable signals, said relay circuit in response to said enable signals connecting power through said auto/manual switch when said switch is in said auto position to control changes of the activated tap;

further comprising a circuit for transmitting an auto sense signal and a manual sense signal to said computer in accordance with the state of said auto/manual switch;

further comprising a raise-lower switch for connecting power through said auto/manual switch when said auto/manual switch is in said manual position to control changes of the activated tap; and further comprising a resettable tap position counter;

the computer updating said tap position counter in response to tap changes executed in accordance with tap change requests and recording maximum and minimum tap positions between resets.

13. A method of monitoring a voltage regulator having a plurality of taps including a reference tap and a tap changer capable of activating any of said taps, the voltage regulator being adapted to receive an input voltage and to produce an output voltage and being constructed so that the output voltage bears a relationship to the input voltage that depends on the activated tap and the tap changer being constructed to activate different taps in response to tap raise and lower requests to maintain the output voltage close to a target level despite fluctuations of the input voltage or load;

said method comprising the steps of:

detecting activation of said reference tap;

providing initial activated-tap information in response to said detection;

storing a history of tap raise and lower requests after the activation of said reference tap; and updating the activated-tap information in accordance with said stored history of tap raise and lower requests made after the activation of the reference tap.

14. A method of monitoring a voltage regulator having a plurality of taps including a neutral tap and a tap changer capable of activating any of said taps, the voltage regulator being adapted to receive an input voltage and to produce an output voltage and being constructed so that the output voltage bears a relationship to the input voltage that depends on the activated tap and the tap changer being constructed to activate different taps as necessary to maintain the output voltage close to a target level despite fluctuations of the input voltage or load;

said method comprising the steps of:

detecting activation of said neutral tap;

providing initial activated-tap information in response to said detection;

storing a history of tar raise and lower requests after the activation of said neutral tap;

updating the activated-tap information in accordance with said stored history of tap raise and lower requests made after the activation of the neutral tap; and keeping track of maximum and minimum tap positions.

15. A method of monitoring a voltage regulator having a plurality of taps including a reference tap and a tap changer capable of activating any of said taps, said method comprising the steps of:

detecting activation of said reference tap;

providing initial activated-tap information in response to said detection;

storing a history of tap raise and lower requests after the activation of said reference tap; and updating the activated-tap information in accordance with said stored history of tap raise and lower requests made after the activation of the reference tap.

16. Monitor apparatus for use with a voltage regulator having a plurality of taps including a reference tap and a tap changer capable of activating any of said taps, said monitor apparatus comprising:

means response to activation of said reference tap for providing initial activated-tap information;

means for storing a history of tap raise and lower requests after the activation of said reference tap; and dead-reckoning means responsive to said stored history of tap raise and lower requests for updating the activated-tap information in accordance with changes of the activated tap made after the activation of the reference tap.

* * * * *